US008790124B2

(12) United States Patent
Lee et al.

(10) Patent No.: US 8,790,124 B2
(45) Date of Patent: Jul. 29, 2014

(54) ELECTRICAL PLUG DEVICE AND ELECTRONIC APPARATUS INCLUDING THE SAME

(71) Applicants: Lite-On Electronics (Guangzhou) Limited, Guangzhou (CN); Lite-On Technology Corp., Taipei (TW)

(72) Inventors: Tung-Yuan Lee, Taipei (TW); Hao Chien, Taipei (TW)

(73) Assignees: Lite-On Electronics (Guangzhou) Limited, Guangzhou (CN); Lite-On Technology Corp., Taipei (TW)

( * ) Notice: Subject to any disclaimer, the term of this patent is extended or adjusted under 35 U.S.C. 154(b) by 62 days.

(21) Appl. No.: 13/676,383

(22) Filed: Nov. 14, 2012

(65) Prior Publication Data

US 2013/0323947 A1 Dec. 5, 2013

(30) Foreign Application Priority Data

Jun. 1, 2012 (CN) ..... 2012 2 0254986 U

(51) Int. Cl.
*H01R 13/44* (2006.01)

(52) U.S. Cl.
USPC ..... 439/131

(58) Field of Classification Search
USPC ..... 439/131
See application file for complete search history.

(56) References Cited

U.S. PATENT DOCUMENTS

| | | | | |
|---|---|---|---|---|
| 6,454,578 | B1 * | 9/2002 | Yao | 439/131 |
| 7,001,196 | B1 * | 2/2006 | Huang | 439/320 |
| 7,481,660 | B1 * | 1/2009 | Tsai | 439/131 |
| 7,628,621 | B2 * | 12/2009 | Tsai | 439/131 |
| 7,638,968 | B2 * | 12/2009 | Inoue et al. | 320/107 |
| 7,798,825 | B1 * | 9/2010 | Pai | 439/131 |
| 2010/0248509 | A1 * | 9/2010 | Pai | 439/131 |
| 2013/0316553 | A1 * | 11/2013 | Lee | 439/131 |

* cited by examiner

*Primary Examiner* — Gary Paumen
(74) *Attorney, Agent, or Firm* — Rosenberg, Klein & Lee

(57) ABSTRACT

An electrical plug device includes a housing that is formed with two receptacles, a positioning member that is disposed in the housing and that includes a base, a fixed arm unit and a flexible arm unit, and a plug member that includes a pivot rod and two plug prongs receivable in the receptacles. The base, the fixed arm unit and the flexible arm unit cooperatively define an engaging groove. The pivot rod includes a rod body pivotally received in the engaging groove and a protrusion protruding from the rod body. The plug prongs are respectively secured in position when respectively protruding out of the receptacles via detachable engagement of the protrusion with and detachable abutment of the rod body against the flexible arm unit.

28 Claims, 13 Drawing Sheets

ELECTRICAL PLUG DEVICE AND ELECTRONIC APPARATUS INCLUDING THE SAME

CROSS-REFERENCE TO RELATED APPLICATION

This application claims priority of Chinese Patent Application No. 201220254986.1, filed on Jun. 1, 2012.

BACKGROUND OF THE INVENTION

1. Field of the Invention

This invention relates to an electrical plug device, more particularly to a foldable electrical plug device, and to an electronic apparatus including the foldable electrical plug device.

2. Description of the Related Art

Currently, a power supply device includes a housing and at least one plug member pivotally connected to the housing. The plug member may rotate relative to the housing between a folding position where the plug member is received in a receptacle formed in the housing and a protruding position where the plug member protrudes out of a side of the housing.

Usually, a positioning structure is disposed in the housing to match the plug member in hopes of securing the plug member at the folding position or the protruding position. However, the current positioning structure fails to achieve the objective of positioning the plug member stably at the protruding position. Hence, it is likely for the plug member to move away from the protruding position upon being plugged into a socket by an applied force, even to the extent that the plug member moves back to the folding position, resulting in inconvenience in use.

SUMMARY OF THE INVENTION

An object of the present invention is to provide an electrical plug device including a plug member that can be positioned stably at a protruding position to protrude out of a housing, and capable of avoiding an undesired movement of the plug member away from the protruding position as caused by an applied force. Thereby, convenience in use of the electrical plug device can be enhanced.

Another object of the present invention is to provide an electrical plug device that includes a plug member capable of being automatically positioned at a folding position or a positioning position.

The objects of this invention and solutions to the prior art problems are accomplished by the following technical means. An electrical plug device disclosed according to this invention includes a housing, a positioning member and a plug member.

The housing is formed with two receptacles. The positioning member is disposed in the housing and includes a base that has two opposite ends, a fixed arm unit that extends upwardly from one of the opposite ends of the base and that is inseparably connected to the housing, and a flexible arm unit that extends upwardly from the other of the opposite ends of the base and opposite to the fixed arm unit. The base, the fixed arm unit and the flexible arm unit cooperatively define an engaging groove. The fixed arm unit and the flexible arm unit cooperatively define an opening that communicates with the engaging groove and that is opposite to the base. The flexible arm unit includes a flexible arm portion that is connected to the base and that has an inner surface facing the fixed arm unit, and a securing projection that includes an engaging surface connected to the inner surface and an abutting surface connected to the engaging surface. The abutting surface is configured as an inclined surface extending towards the fixed arm unit so that the engaging groove gradually decreases in width in a direction towards the opening.

The plug member includes a pivot rod that is pivotally coupled to the positioning member and two spaced-apart plug prongs that are connected to the pivot rod. The plug prongs are respectively and removably received in the receptacles. The pivot rod includes a rod body pivotally received in the engaging groove and detachably abutting against the abutting surface of the securing projection, and a protrusion protruding from the rod body and detachably engaged with the engaging surface of the securing projection. The engaging surface of the securing projection is engaged with the protrusion of the pivot rod, and the abutting surface of the securing projection abuts against the rod body when the plug member is disposed at a protruding position, where the plug prongs of the plug member protrude out of the receptacles, respectively.

Yet another object of the present invention is to provide an electronic apparatus including an electrical plug device. The electrical plug device includes a plug member that can be positioned stably at a protruding position to protrude out of a housing, and is capable of avoiding undesired movement of the plug member away from the protruding position caused by an undesirable external force. Thereby, convenience in use of the electrical plug device can be enhanced.

Still yet another object of the present invention is to provide an electronic apparatus including an electrical plug device. The electrical plug device includes a plug member capable of being automatically positioned at a folding position or a positioning position.

An electronic apparatus disclosed according to this invention includes a main body and the electrical plug device.

The main body includes a casing, an adapter socket disposed on the casing, and a circuit board disposed in the casing and coupled electrically to the adapter socket.

The electrical plug device is coupled electrically to the adapter socket and includes a housing, a positioning member and a plug member.

The housing is formed with two receptacles. The positioning member is disposed in the housing and includes a base that has two opposite ends, a fixed arm unit that extends upwardly from one of the opposite ends of the base and that is inseparably connected to the housing, and a flexible arm unit that extends upwardly from the other of the opposite ends of the base and opposite to the fixed arm unit. The base, the fixed arm unit and the flexible arm unit cooperatively define an engaging groove. The fixed arm unit and the flexible arm unit cooperatively define an opening that communicates with the engaging groove and that is opposite to the base. The flexible arm unit includes a flexible arm portion that is connected to the base and that has an inner surface facing the fixed arm unit, and a securing projection that is connected to and that includes an engaging surface connected to the inner surface and an abutting surface connected to the engaging surface. The abutting surface is configured as an inclined surface extending towards the fixed arm unit so that the engaging groove gradually decreases in width in a direction towards the opening.

The plug member includes a pivot rod that is pivotally coupled to the positioning member and two spaced-apart plug prongs that are connected to the pivot rod. The plug prongs are respectively and removably received in the receptacles. The pivot rod includes a rod body pivotally received in the engaging groove and detachably abutting against the abutting surface of the securing projection, and a protrusion protruding from the rod body and detachably engaged with the engaging surface of the securing projection. The engaging surface of the securing projection is engaged with the protrusion of the pivot rod, and the abutting surface of the securing projection abuts against the rod body when the plug member is disposed at a protruding position, where the plug prongs of the plug member protrude out of the receptacles, respectively.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
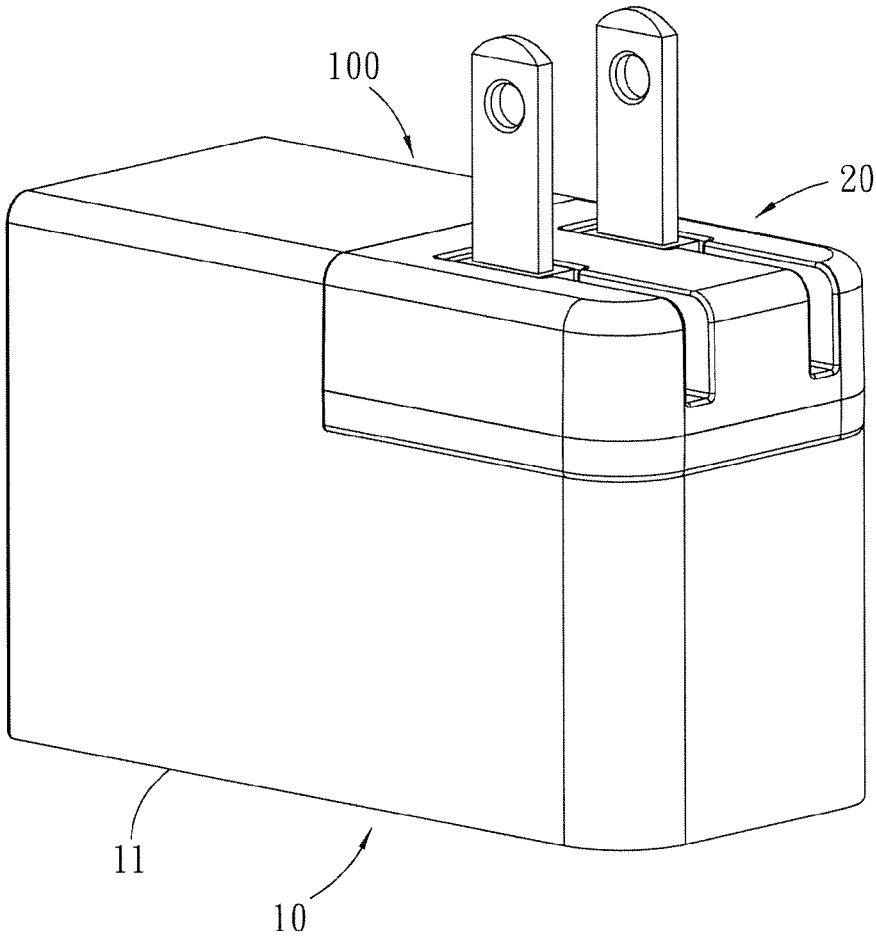
FIG. 1 is a perspective view of the preferred embodiment of an electronic apparatus including an electrical plug device according to the present invention, illustrating the electrical plug device and a main body of the electronic apparatus in an assembled state.
Figure 2:
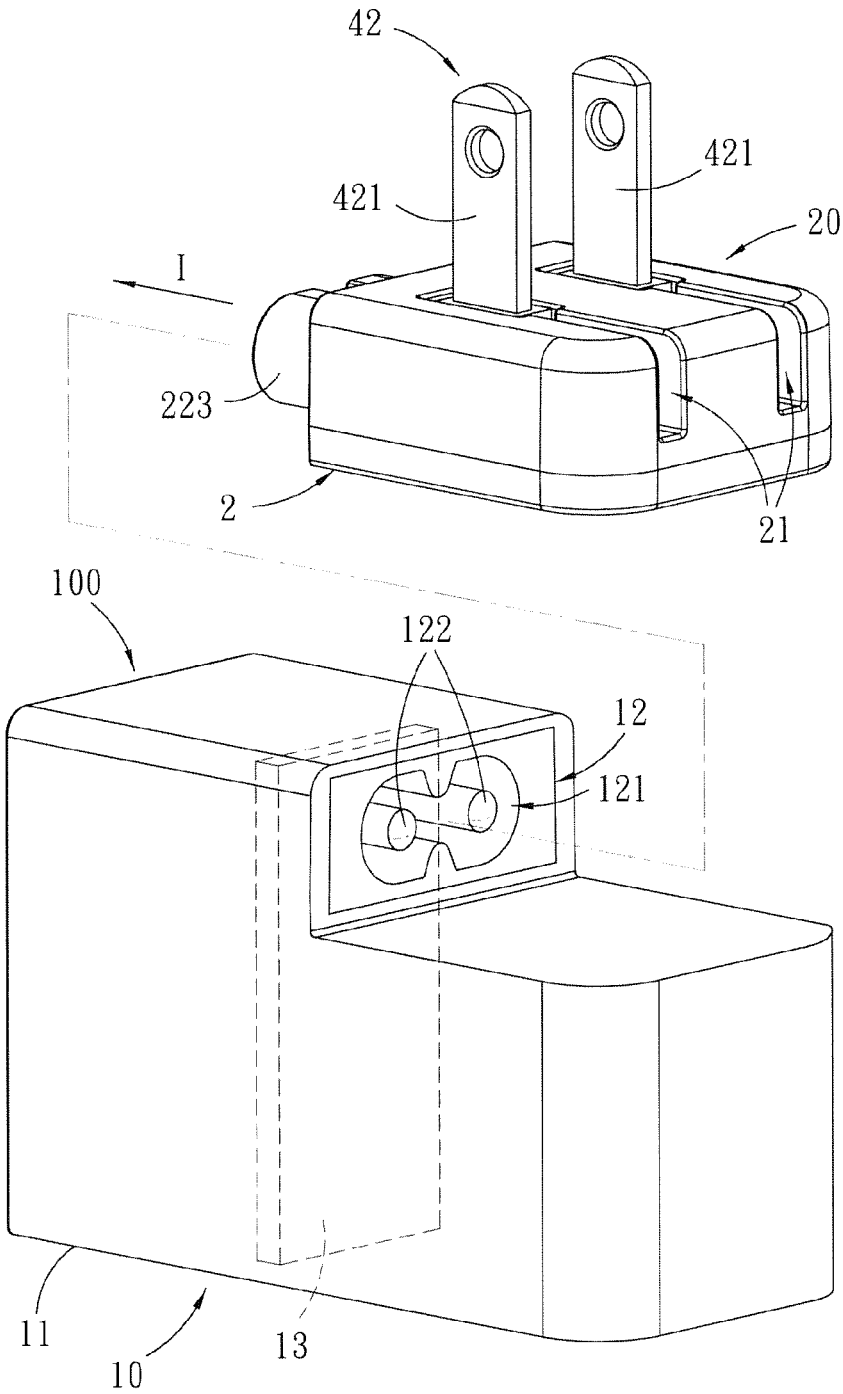
FIG. 2 is a perspective view of the electronic apparatus, illustrating the electrical plug device and the main body in a disassembled state.

Referring to FIGS. 1 to 2, the preferred embodiment of an electronic apparatus 100 including an electrical plug device 20 according to the present invention is illustrated. The electronic apparatus 100 is illustrated as a power converter as an example. In addition to the electrical plug device 20, the electronic apparatus 100 further includes a main body 10. The main body 10 includes a casing 11, an adapter socket 12 that is disposed on the casing 11 and a circuit board 13 that is disposed in the casing 11 and that is electrically coupled to the adapter socket 12. The electrical plug device 20 is assembled with and electrically coupled to the adapter socket 12. The electrical plug device 20 is adapted to be plugged in an external power socket (not shown), so that electrical power is transmitted from the external power socket to the circuit board 13 through the electrical plug device 20 and the adapter socket 12. The electrical power may be directly supplied to different types of electrical appliances or be used in charging rechargeable battery after being rectified and converted by the circuit board 13.

Figure 3:
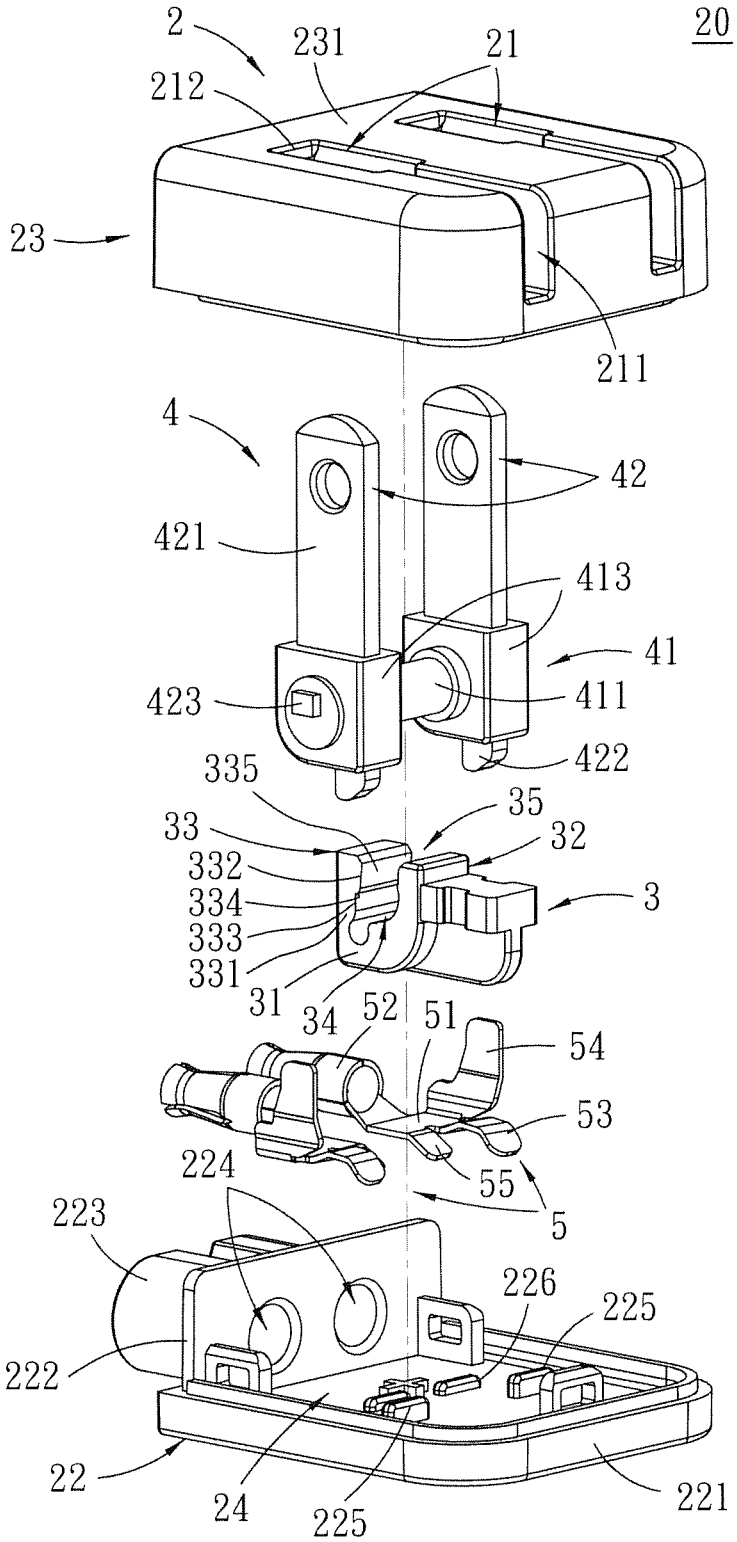
FIG. 3 is an exploded perspective view of the electrical plug device, illustrating the structural relationships among a housing, a plug member, a positioning member, and two guide terminals.
Figure 4:
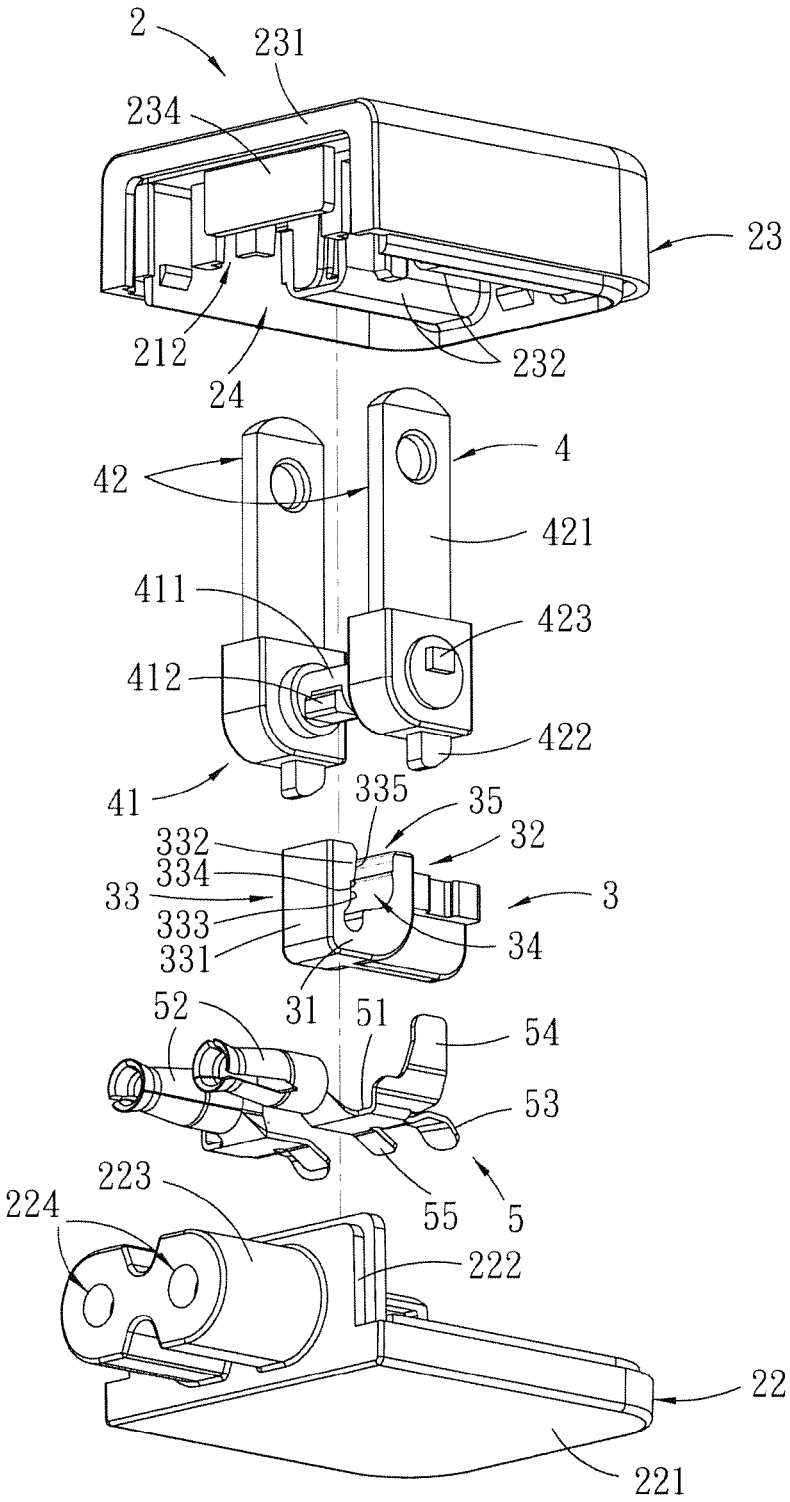
FIG. 4 is another exploded perspective view of the electrical plug device taken from a viewing angle different from that of FIG. 3, illustrating the structural relationships among the housing, the plug member, the positioning member, and the guide terminals.
Figure 5:
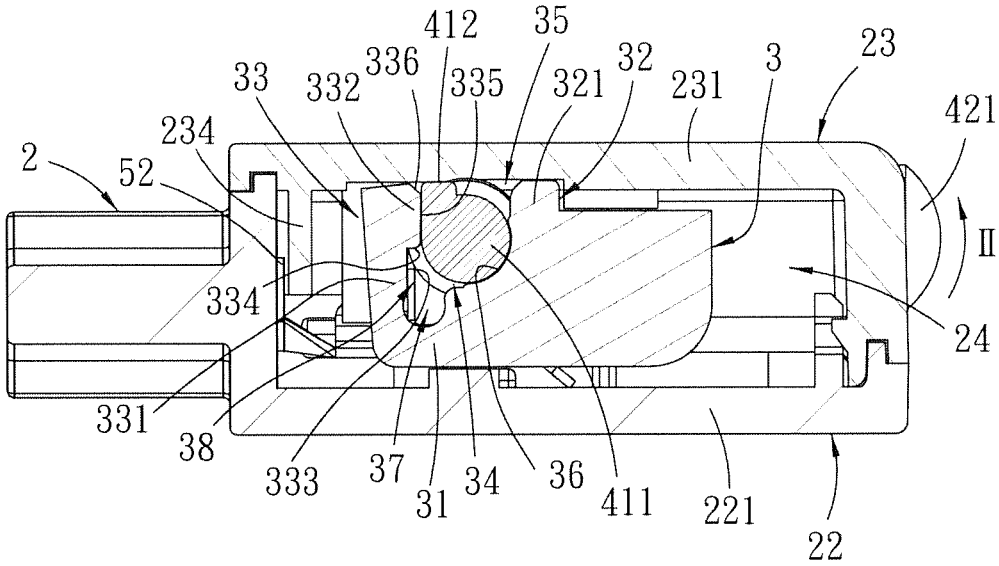
FIG. 5 is a sectional view of the electrical plug device, illustrating the plug member disposed at a folding position.

Referring to FIGS. 3 to 5, the electrical plug device 20 includes a housing 2, a positioning member 3, and a plug member 4. The housing 2 is formed with two receptacles 21. The positioning member 3 is disposed in the housing 2 and includes a base 31 that has two opposite ends, a fixed arm unit 32 that extends upwardly from one of the opposite ends of the base 31 and that is inseparably connected to the housing 2, and a flexible arm unit 33 that extends upwardly from the other of the opposite ends of the base 31 and opposite to the fixed arm unit 32. The base 31, the fixed arm unit 32, and the flexible arm unit 33 cooperatively define an engaging groove 34. The fixed arm unit 32 and the flexible arm unit 33 cooperatively define an opening 35 in communication with the engaging groove 34 and opposite to the base 31. The flexible arm unit 33 includes a flexible arm portion 331 that is connected to the base 31 and a securing projection 332 that is connected to the flexible arm portion 331. The flexible arm portion 331 has an inner surface 333 facing the fixed arm unit 32, and the securing projection 332 includes an engaging surface 334 connected to the inner surface 333 and an abutting surface 335 connected to the engaging surface 334. The abutting surface 335 is configured as an inclined surface extending towards the fixed arm unit 32 so that the engaging groove 34 gradually decreases in width along a direction towards the opening 35.

The plug member 4 includes a pivot rod 41 that is pivotally coupled to the positioning member 3, and two spaced-apart plug prongs 42 that are connected to the pivot rod 41. In this embodiment, the plug member 4 is pivoted between a folding position where the plug prongs 42 are respectively received in the receptacles 21 (as shown in FIG. 5) and a protruding position where the plug prongs 42 respectively protrude out of the receptacles 21 (as shown in FIG. 2).

The pivot rod 41 includes a rod body 411 pivotally received in the engaging groove 34 and detachably abutting against the abutting surface 335 of the securing projection 332, and a protrusion 412 protruding from the rod body 411 and detachably engaged with the engaging surface 334 of the securing projection 332. When the plug member 4 is disposed at the protruding position, where the plug prongs 42 respectively protrude out of the receptacles 21, the engaging surface 334 is engaged with the protrusion 412, and the abutting surface 335 abuts against the rod body 411. In addition, when the plug member 4 is positioned at the folding position, the plug prongs 42 are respectively received in the receptacles 21, the abutting surface 335 of the securing projection 332 abuts against the protrusion 412 and the rod body 411.

By means of the engagement of the engaging surface 334 of the securing projection 332 with the protrusion 412 and the abutment of the abutting surface 335 of the securing projection 332 with the rod body 411, the plug member 4 is firmly positioned at the protruding position and is prevented from moving into the folding position due to an undesirably applied force, thereby increasing convenience in use.

The structure and the operation of the electrical plug device 20 are elaborated with the following detailed description.

Referring to FIGS. 2 to 4, the adapter socket 12 of the main body 10 includes a slot 121 and two spaced-apart switch pins 122 disposed in the slot 121. Each of the switch pins 122 is soldered to a corresponding electrical contact (not shown) on the circuit board 13. The electrical plug device 20 further includes two guide terminals 5 disposed in the housing 2. When the electrical plug device 20 is plugged in the slot 121, each of the guide terminals 5 is electrically coupled to a corresponding one of the switch pins 122. When the plug member 4 is disposed at the protruding position, each of the plug prongs 42 is electrically connected to a corresponding one of the guide terminals 5. Thereby, an external electrical power is able to be transmitted from the plug prongs 42 to the circuit board 13 through the guide terminals 5 and the switch pins 122.

In this embodiment, the housing 2 includes a lower housing member 22 and an upper housing member 23 connected to the lower housing member 22. The lower and upper housing members 22, 23 cooperatively define a receiving space 24 for receiving the positioning member 3 and the guide terminals 5. The lower housing member 22 includes a bottom wall 221, a rear sidewall 222 extending upwardly from the bottom wall 221, and an insertion portion 223 projecting outwardly from the rear sidewall 222. The insertion portion 223 is adapted to be inserted into the slot 121 of the adapter socket 12. Two through holes 224 are formed in the lower housing member 22 to communicate with the receiving space 24 and to extend through the rear sidewall 222 and the insertion portion 223.

Figure 6:
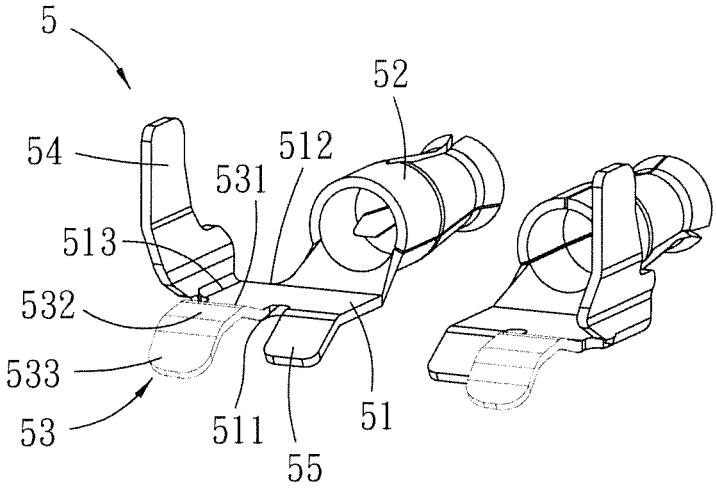
FIG. 6 is a perspective view of the guide terminals of the electrical plug device.

Further referring to FIGS. 3, 4 and 6, each of the guide terminals 5 is made of a metal material and includes a base plate 51 disposed in the receiving space 24, a guide sleeve 52, a first guide plate 53 and a second guide plate 54. The base plate 51 has a front end 511, a rear end 512 and a lateral end 513 interconnecting the front and rear ends 511, 512. The guide sleeve 52 extends rearwardly from the rear end 512 of the base plate 51 and is plugged in a corresponding one of the through holes 224 for sleeving on the corresponding one of the switch pins 122 (as shown in FIG. 2), so that the guide terminal 5 is electrically coupled to the corresponding one of the switch pins 122 through the guide sleeve 52 thereof. Preferably, the first guide plate 53 extends forwardly from the front end 511 of the base plate 51 and the second guide plate 54 extends upwardly from the lateral end 513 of the base plate 51. The first and second guide plates 53, 54 of each guide terminal 5 abut against the corresponding one of the plug prongs 42, so that the guide sleeve 52 is electrically coupled to the corresponding one of the plug prongs 42 through the first and second guide plates 53, 54 thereof.

Figure 7:
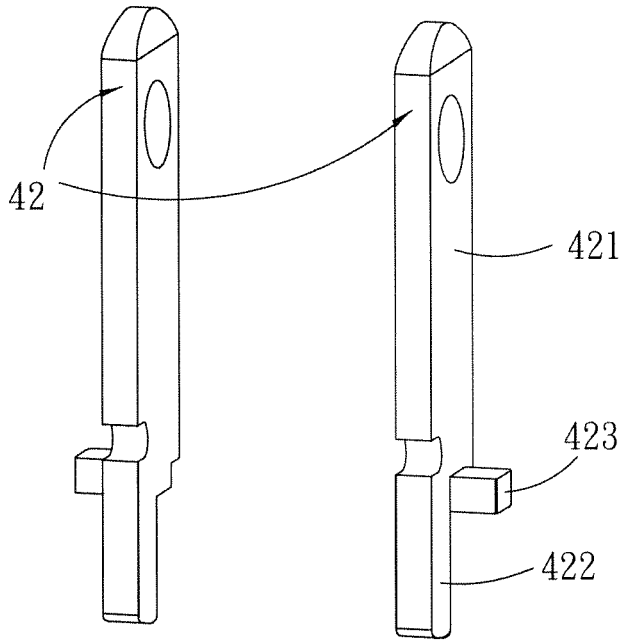
FIG. 7 is a perspective view of two plug prongs of the plug member of the electrical plug device.

With reference to FIGS. 3, 4 and 7, each of the plug prongs 42 is made of a metal material by a punching process. The configuration of each plug prong 42 after the punching process is shown in FIG. 7. Each of the plug prongs 42 includes an elongate plug portion 421 protruding from the pivot rod 41 and receivable in the corresponding receptacle 21, a first guide portion 422 protruding from an end portion of the elongate plug portion 421 in a direction opposite to a protruding direction of the plug portion 421, and a second guide portion 423 extending transversely from the end portion of the elongate plug portion 421. Since each of the plug prongs 42 is integrally manufactured by the punching process, the process of making the plug prongs 42 can be simplified to reduce complexity and process time, thereby reducing the fabrication cost of the plug prongs 42.

The pivot rod 41 of the plug member 4 is made of an insulating material having relatively good wear-resistance. The pivot rod 41 includes two opposite enclosing portions 413 disposed on two opposite ends of the rod body 411. The two plug prongs 42 are respectively connected to the enclosing portions 413 using insert molding. Each of the enclosing portions 413 covers a part of the corresponding one of the plug prongs 42. The elongate plug portion 421 of each of the plug prongs 42 protrudes outwardly from a first end of the corresponding one of the enclosing portions 413 of the pivot rod 41. The elongate plug portions 421 are adapted to be plugged in the external power socket. The first guide portion 422 of each of the plug prongs 42 projects opposite to the elongate plug portion 421 from a second end of the enclosing portion 413 opposite to the first end. The first guide portions 422 abut against the first guide plates 53 of the guide terminals 5, respectively. The second guide portion 423 of each of the plug prongs 42 projects outwardly and transversely from the enclosing portion 413 of the pivot rod 41, thereby abutting against the second guide plates 54 of the corresponding one of the guide terminals 5.

The two receptacles 21 are formed in the upper housing member 23. The upper housing member 23 includes a top wall 231, and two indented peripheral walls 232 indented from the top wall 231, respectively. Each of the receptacles 21 has a groove 211 defined by the top wall 231 and a corresponding one of the indented peripheral walls 232, and a communicating hole 212 extending through the top wall 231 and communicating with the groove 211 and the receiving space 29. As a result, the groove 211 also communicates with the receiving space 24. Each of the enclosing portions 413 of the pivot rod 41 is penetrated through the communicating hole 212 of the corresponding one of the receptacles 21, so that the elongate plug portion 421 of each of the plug prongs 421 is able to be received in the groove 211 of the corresponding receptacle 21.

Figure 8:
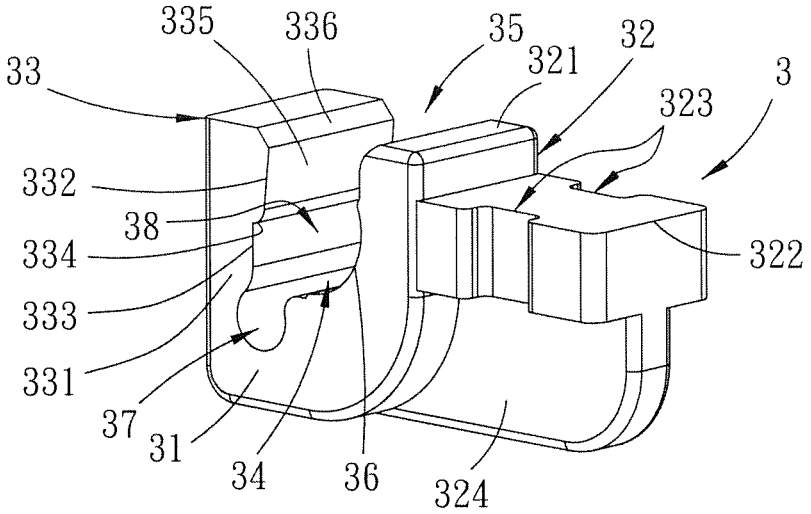
FIG. 8 is a perspective view of the positioning member of the electrical plug device.
Figure 9:
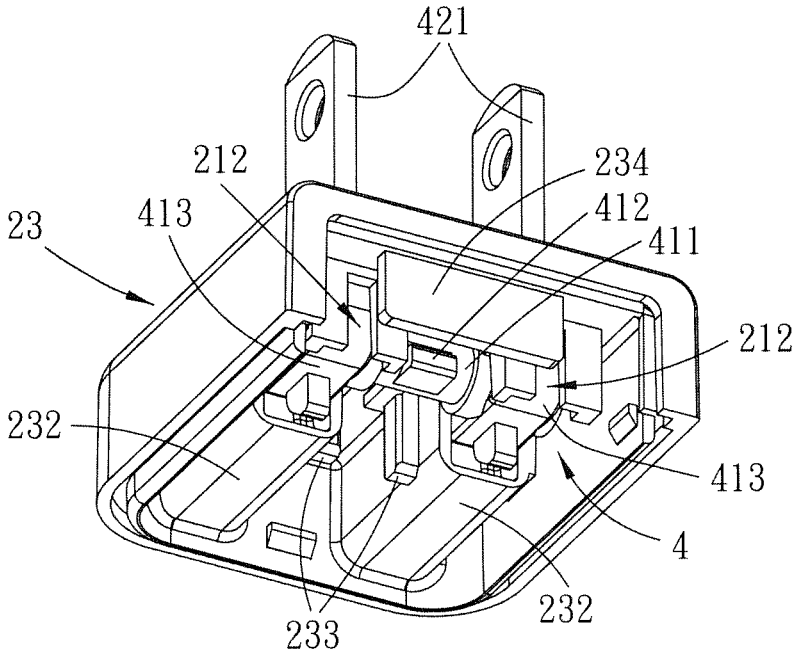
FIG. 9 is a perspective bottom view of the electrical plug device, illustrating two enclosing portions of a pivot rod of the plug member respectively inserted into two communicating holes of two receptacles formed in the housing.

Referring to FIGS. 4, 8 and 9, the positioning member 3 is made of an insulating material having relatively good wear-resistance. The fixed arm unit 32 of the positioning member 3 includes an upright wall 321 that extends from the base 31 and that is spaced apart from the flexible arm unit 33, and a protruding wall 322 that laterally protrudes from the upright wall 321 in a direction further away from the flexible arm unit 33. The protruding wall 322 is formed with two opposite retaining grooves 323 that extend along a lengthwise direction of the flexible arm unit 33. Further referring to FIG. 9, each of the two indented peripheral walls 232 of the upper housing member 23 of the housing 2 has a surface. The surfaces of the indented peripheral walls 232 face each other and are each formed outwardly with a positioning rib 233. The positioning ribs 233 of the surfaces are spaced apart from each other and extend along the lengthwise direction of the upright wall 321, and are respectively received in the retaining grooves 323 in the protruding wall 322 so as to restrict back and forth displacement of the protruding wall 322 of the positioning member 3 relative to the housing 2. Preferably, the fixed arm unit 32 further includes a strengthening wall 324 interconnecting the upright wall 321 and the protruding wall 322, thereby enhancing structural strength between the upright wall 321 and the protruding wall 322.

Figure 10:
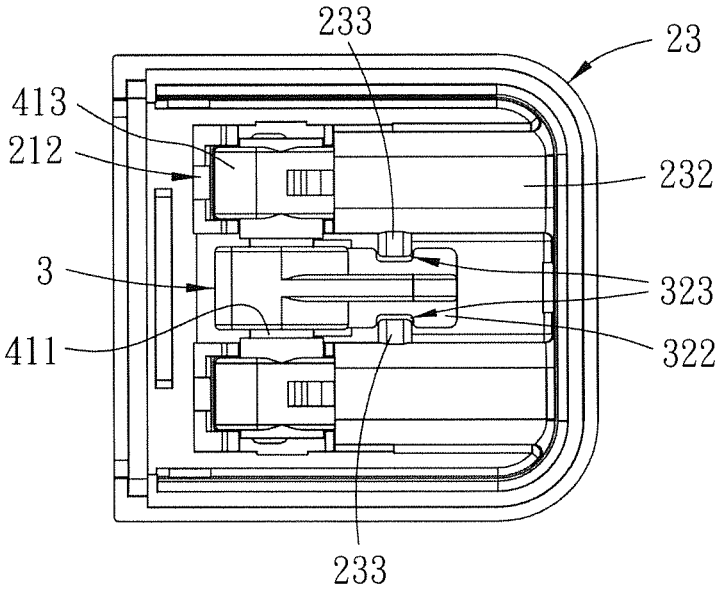
FIG. 10 is a schematic view of the electrical plug device, illustrating the positioning member assembled with the plug member and two spaced-apart positioning ribs of the housing respectively abutting against retaining grooves that are formed in the positioning member.
Figure 11:
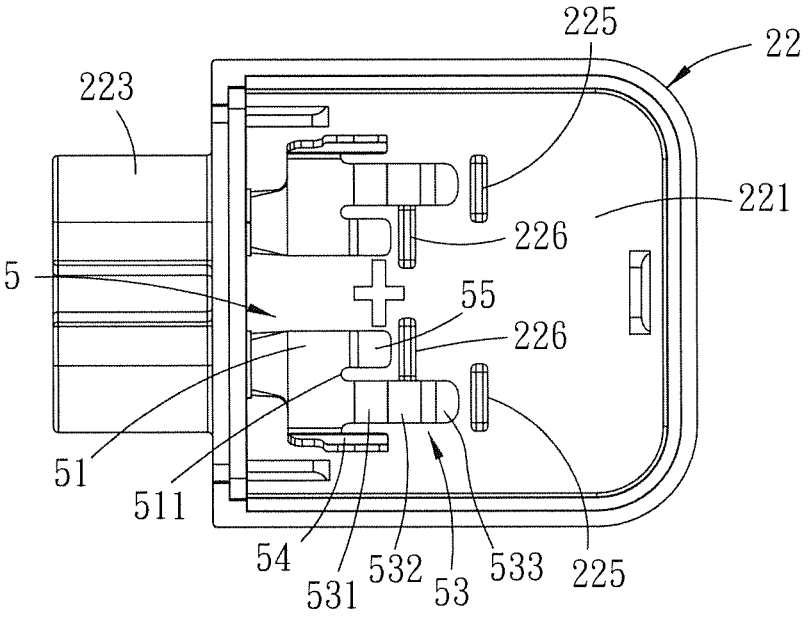
FIG. 11 is a schematic view of the electrical plug device, illustrating conductive sleeves of the guide terminals positioned in the through holes of a lower housing member of the housing.

Referring to FIGS. 3, 9 and 10, to assemble the electrical plug device 20, the elongate plug portions 421 of the plug member 4 are respectively inserted through the communicating holes 212 of the receptacles 21 until the two enclosing portions 413 of the plug member 4 are respectively received in the two communicating holes 212. Then, the positioning member 3 is assembled to the pivot rod 41 of the plug member 4 by inserting the rod body 411 and the protrusion 412 of the pivot rod 41 into the engaging groove 34 through the opening 35 of the positioning member 3 so that the positioning ribs 233 of the upper housing member 23 are respectively received in the retaining grooves 323. On the other hand, the guide sleeve 52 of each of the guide terminals 5 is inserted into the corresponding one of the through holes 224 in the lower housing member 22, so that each of the guide terminals 5 is assembled to the lower housing member 22 as shown in FIG. 11. Finally, the upper housing member 23 and the lower housing member 22 are engaged and soldered together using ultrasonic welding. At this time, assembly of the electrical plug device 20 is completed. Meanwhile, as shown in FIG. 5, the positioning member 3 is sandwiched between the top wall 231 of the upper housing member 23 and the bottom wall 221 of the lower housing member 22, thereby restricting up and down displacement of the positioning member 3 relative to the housing 2. Therefore, the positioning member 3 is able to be stably positioned in the receiving space 24.

With reference to FIGS. 2, 4 and 5, after assembly of the electrical plug device 20 is accomplished, the insertion portions 223 are able to be plugged in the slot 121 of the adapter socket 12 in a direction indicated by an arrow (I) as shown in FIG. 2. In this embodiment, the upper housing member 23 of the electrical plug device 20 further includes a blocking plate 234 extending downwardly from the top wall 231 and proximate to the communicating holes 212 so as to block a free end of the guide sleeve 52 of each of the guide terminals 5. The blocking plate 234 is a primary blocking mechanism to block and restrict movement of the guide sleeves 52. When each of the switch pins 122 of the adapter socket 12 is inserted into and frictionally contacts the guide sleeve 52 of the corresponding one of the guide terminals 5, the guide sleeve 52 is able to be stably positioned in the corresponding one of the through holes 224 without being detached therefrom due to abutment with the switch pin 122. Thereby, each of the guide sleeves 52 is reliably sleeved on and electrically coupled to the corresponding one of the switch pins 122.

Referring to FIGS. 3, 6 and 11, the first guide plate 53 of each guide terminal 5 has a first inclined portion 531 extending forwardly from the front end 511 of the base plate 51 and being inclined upwardly, a contact portion 532 extending forwardly and horizontally from the first inclined portion 531, and a second inclined portion 533 extending forwardly from the contact portion 532 and inclined downwardly. The lower housing member 22 of the housing 2 further includes two spaced-apart first stopper portions 225 disposed on and protruding from an inner surface of the bottom wall 221. Each of the first stopper portions 225 is used to block the second inclined portion 533 of the first guide plate 53 of a corresponding one of the guide terminals 5. Therefore, the first stopper portions 225 may serve as secondary blocking mechanisms to block and restrict movement of the guide terminals 5, respectively. In addition, each of the guide terminals 5 further includes an inclined plate 55 extending downwardly from the front end 511 of the base plate 54 and spaced apart from the first guide plate 53. The lower housing member 22 of the housing 2 further includes two spaced-apart second stopper portions 226 disposed on and protruding from the inner surface of the bottom wall 221. Each of the second stopper portions 226 is used to secure the inclined plate 55 of a corresponding one of the guide terminals 5. Therefore, the second stopper portions 226 can also serve as the secondary blocking mechanisms to block and restrict movement of the guide terminals 5.

Figure 12:
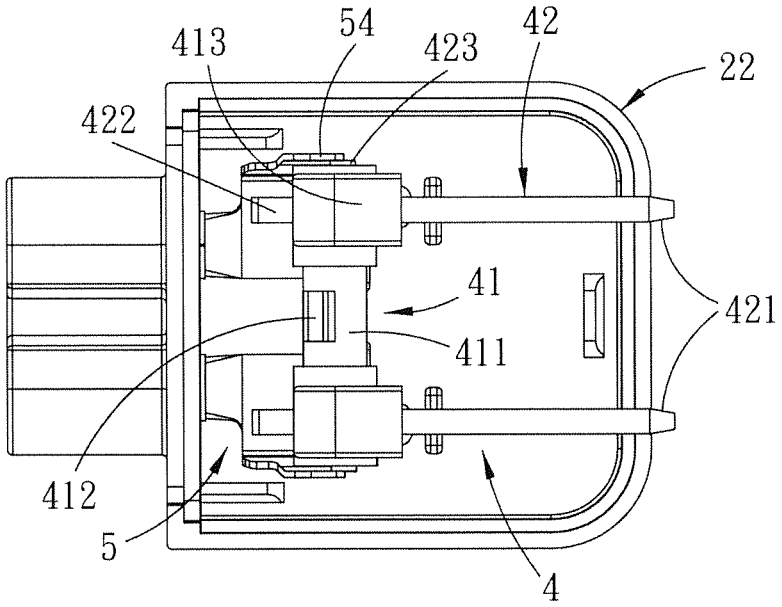
FIG. 12 is a bottom view of the electrical plug device, illustrating the plug member disposed at the folding position.

Referring to FIGS. 3, 5 and 12, when the plug member 4 is disposed at the folding position, the two plug portions 421 of the plug member 4 are respectively received in the grooves 211 of the two receptacles 21. In the meantime, the abutting surface 335 of the securing projection 332 of the flexible arm unit 33 abuts against the protrusion 412 and the rod body 411 of the pivot rod 41, so that the rod body 411 is forced to abut against a curved bearing surface 36 that is cooperatively defined by the base 31 and the upright wall 321. Therefore, the rod body 411 is clamped cooperatively by the flexible arm unit 33, the base 31, and the upright wall 321 of the fixed arm unit 32, so that the plug member 4 is firmly positioned at the folding position.

Through a design of the curved bearing surface 36 cooperatively defined by the base 31 and the upright wall 321, a relatively large contact area is formed among the base 31, the upright wall 321, and the rod body 411. Therefore, the curved bearing surface 36 can firmly support the rod body 411, so as to prevent the rod body 411 from vibrating between the flexible arm unit 33 and the upright wall 321. Besides, when the plug member 9 is disposed at the folding position, the first guide portion 422 of each of the plug prongs 42 is detached from the first guide plate 53 of the corresponding one of the guide terminals 5, and the second guide portion 423 of each of the plug prongs 42 abuts against an inner surface of the second guide plate 54 of the corresponding one of the guide terminals 5.

Figure 13:
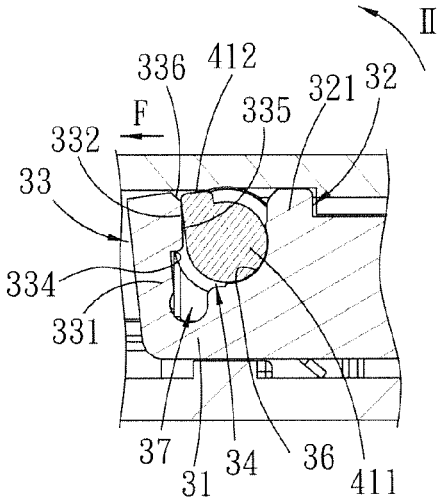
FIG. 13 is an enlarged fragmentary sectional view of the electrical plug device, illustrating a protrusion of the plug member abutting against a securing projection of the positioning member and applying a force thereto.

Referring to FIGS. 5 and 13, when the plug member 4 is rotated from the folding position to the protruding position, an applied force acts on the plug portions 421 to move the same along a direction of an arrow (II). Since the top wall 231 of the upper housing member 23 and the bottom wall 221 of the lower housing member 22 cooperatively clamp the positioning member 3, up and down displacement of the fixed arm unit 32 of the positioning member 3 is restricted. Moreover, as shown in FIG. 10, because the positioning ribs 233 of the upper housing member 23 respectively abut against the retaining grooves 323 of the protruding wall 322 of the fixed arm unit 32 of the positioning member 3, back and forth displacement of the fixed arm unit 32 is restricted. Therefore, the fixed arm unit 32 of the positioning member 3 is stably positioned and kept stationary in the receiving space 24 (see FIG. 5). In this embodiment, the fixed arm unit 32 and the base 31 cooperatively retain the position of the rod body 411. When the protrusion 412 is rotated in the direction of the arrow (II) and abuts against a guide bevel 336 that is connected to the abutting surface 335 and opposite to the engaging surface 334 of the securing projection 332, a lateral push force (F) acts on the guide bevel 336 and urges the flexible arm portion 331 of the flexible arm unit 33 to bend and deform relative to the base 31 in a direction away from the upright wall 321, so that the rod body 411 can pivotally rotate in the engaging groove 39.

Preferably, in order to make the flexible arm portion 331 of the flexible arm unit 33 have a predetermined resiliency and tend to be more deformable and bendable relative to the base 31, a notch 37 with a curved shape is indented from a junction of the base 31 and the flexible arm portion 331. The notch 37 is in communication with the engaging groove 34. Through the design of the notch 37, the junction between the flexible arm portion 331 and the base 31 has a reduced thickness. Therefore, the lateral push force (F) resulting from the rotation of the protrusion 412 can more easily act on the guide bevel 336 to force the flexible arm portion 331 of the flexible arm unit 33 to deform and bend relative to the base 31 in the direction away from the upright wall 321 and to store a restoring force.

Figure 14:
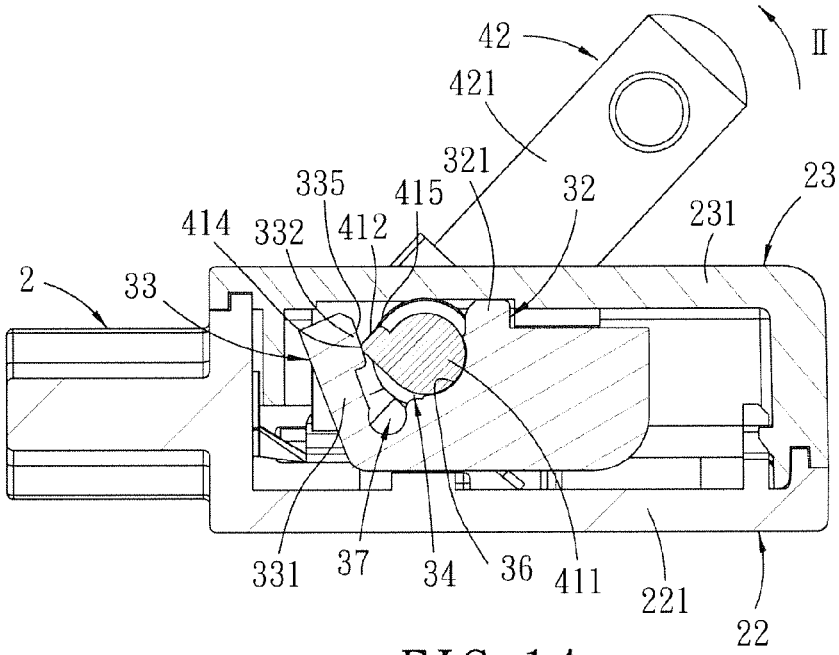
FIG. 14 is a sectional view of the electrical plug device, illustrating rotation of the plug member.
Figure 15:
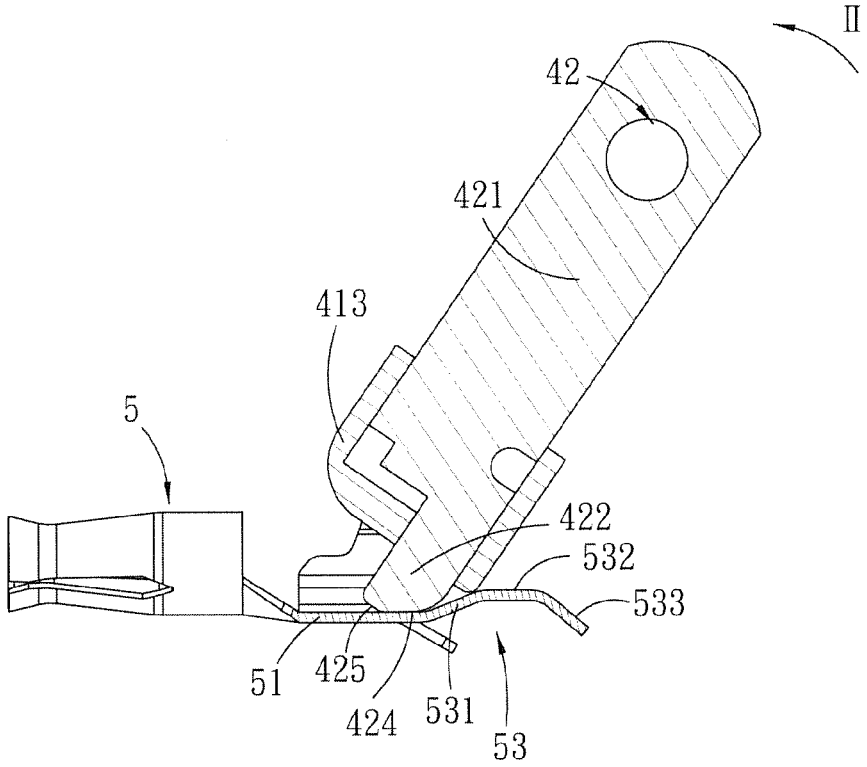
FIG. 15 is a partly sectional view of the electrical plug device, illustrating first guide portions of the plug member abutting against first inclined portions of the guide terminals, respectively.

Referring to FIGS. 14 and 15, when the protrusion 412 is rotated to abut against the abutting surface 335, the bending in the flexible arm portion 331 of the flexible arm unit 33 relative to the base 31 is increased. For example, when the plug member 4 is rotated to an angle of 45 degrees with respect to the lengthwise direction of the base 31 (as illustrated in FIG. 14), a first end 414 of the protrusion 412 abuts against the abutting surface 335 of the securing projection 332. Meanwhile, as shown in FIG. 15, the first guide portions 422 (only one can be seen in FIG. 15) of the plug member 4 respectively abut against and are stopped by the first inclined portions 531 of the first guide plates 53 of the guide terminals 5, thereby making a user feel the plug member 4 impeded. At this moment, the user needs to increase the force exerted thereby to rotate the plug portions 421, so that the force is sufficient to downwardly bend and deform the first inclined portions 531 of the first guide plates 53 relative to the base plates 51 by way of abutment bevels 424 (only one can be seen in FIG. 15) of the first guide portions 422 respectively abutting forcedly against the first inclined portions 531 of the first guide plates 53 of the guide terminals 5. Since the first inclined portions 531 are bent downwardly due to the abutment bevels 424 respectively abutting thereagainst, the first inclined portions 531 are unable to block rotational paths of the first guide portions 422. Therefore, the plug member 4 is able to continuously rotate in the direction of the arrow (II) as shown in FIG. 15.

Figure 16:
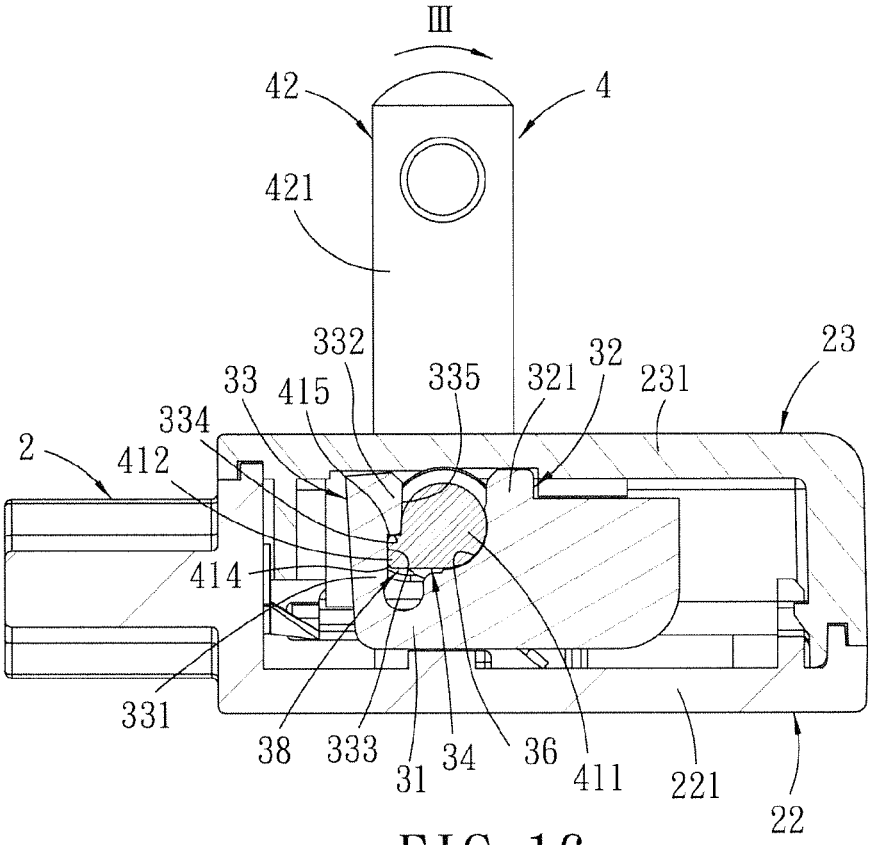
FIG. 16 is a sectional view of the electrical plug device, illustrating the plug member disposed at a protruding position.

Referring to FIG. 16, when the first end 414 of the protrusion 412 is rotated to a position where the same is detached from the abutting surface 335, and where a second end 415 of the protrusion 412 opposite to the first end 414 is passed over the securing projection 332, the protrusion 412 corresponds in position to a positioning groove 38 that is cooperatively defined by the inner surface 333 of the arm portion 331 and the engaging surface 334 of the securing projection 332 and that communicates with the engaging groove 34. At this time, the flexible arm unit 33 is restored to its original position by virtue of the restoring force stored in the flexible arm portion 331, such that the engaging and abutting surfaces 334, 335 of the securing projection 332 are respectively engaged with and abut respectively against the second end 415 of the protrusion 412 and the rod body 411, and such that the protrusion 412 is engaged in the positioning groove 38. In this embodiment, the engaging surface 334 is configured as a curved surface, and the abutting surface 335 is configured as an inclined surface that approaches the fixed arm unit 32 in a direction away from the base 31. The engaging surface 334 may also be configured as an inclined surface. Since the engaging surface 334 secures the second end 415 of the protrusion 412, and by way of the abutting surface 335 engaging the rod body 411, the rod body 411 is forced to tightly abut against the curved bearing surface 36. Through the automatic restoration of the flexible arm unit 33, the base 31 and the upright wall 321 of the fixed arm unit 32 can cooperatively secure the rod body 411 and the protrusion 412 in position, so that the plug member 4 is stably positioned in the protruding position as shown in FIG. 16.

Figure 17:
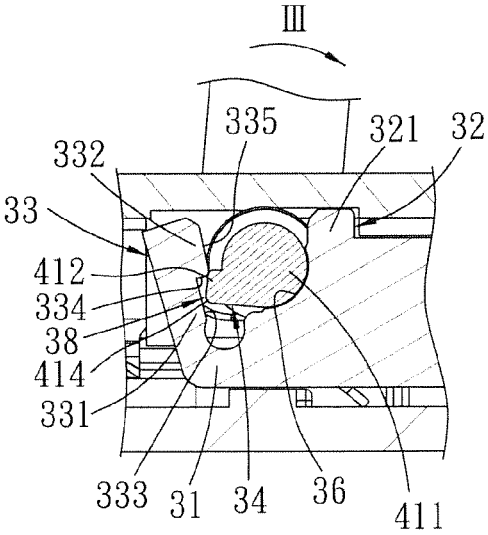
FIG. 17 is an enlarged fragmentary sectional view of the electrical plug device, illustrating the protrusion disengaging from a positioning groove in the positioning member and an engaging surface of the positioning member so as to abut against an abutting surface of the positioning member.

Specifically, when an undesirable external force is applied to act on the plug portions 421 along a direction of an arrow (III) as shown in FIG. 17 such that the protrusion 412 pushes upwardly against the engaging surface 334, a reaction force applied by the engaging surface 334 on the protrusion 412 urges the protrusion 412 to return back into the positioning groove 38. Therefore, the engaging surface 334 can provide a first anti-rebound mechanism to prevent the plug member 4 from rebounding back the folding position due to the undesirable external force. If the undesirable external force is relatively greater such that the protrusion 912 is removed from the positioning groove 38 and disengaged from the engaging surface 339 as shown in FIG. 17, the restoring force stored in the flexible arm portion 331 urges the abutting surface 335 of the securing projection 332 to move toward the upright wall 321 of the fixed arm portion 32, in turn urging the protrusion 412 to move toward the base 31, so that the protrusion 412 is returned into the positioning groove 38. Therefore, the abutting surface 335 can provide a second anti-rebound mechanism to prevent the plug member 4 from rebounding back to the folding position due to the relatively greater external force.

Figure 18:
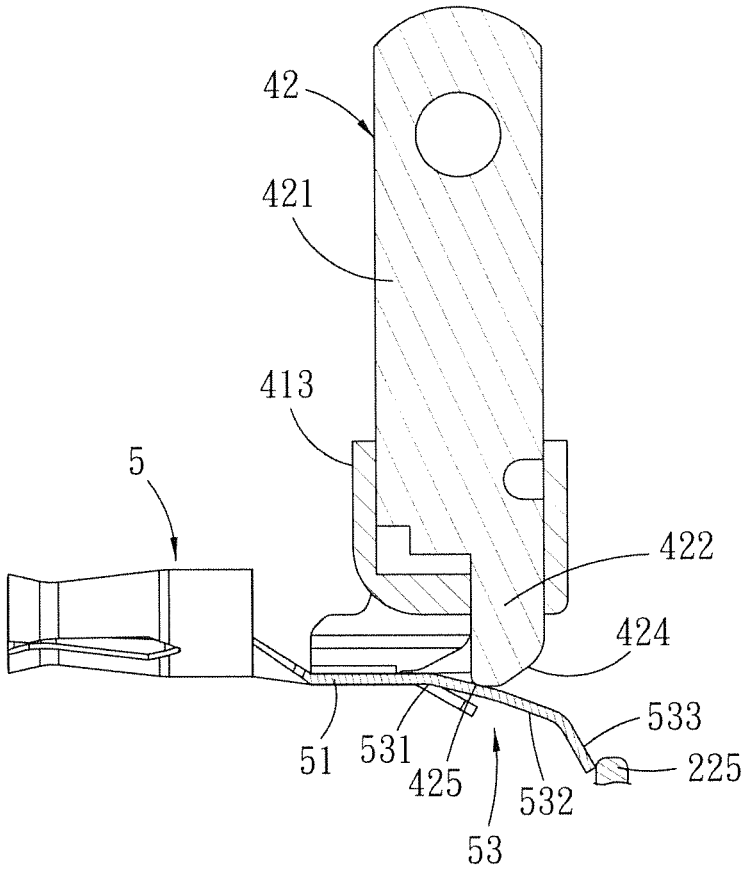
FIG. 18 is a fragmentary and partly sectional view of the electrical plug device, illustrating a contact periphery of one of the first guide portions abutting against a contact portion of a first guide plate of a corresponding one of the guide terminals.
Figure 19:
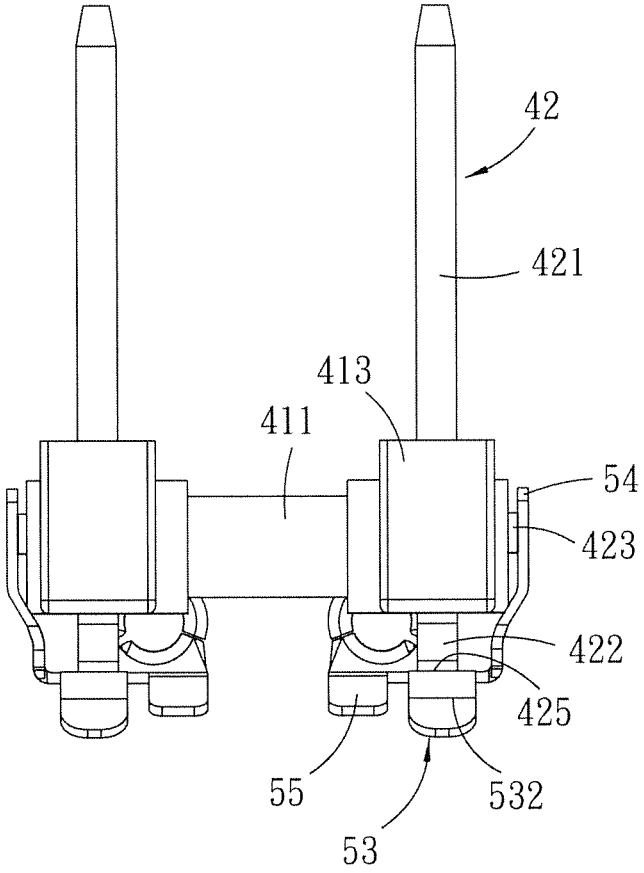
FIG. 19 is a rear view illustrating the contact portions of the first guide plates respectively abutting against the contact peripheries of the first guide portions, and second guide portions respectively abutting against inner surfaces of second guide plates of the guide terminals.

Referring to FIGS. 18 and 19, when the plug member 4 is disposed at the protruding position, a contact periphery 425 of the first guide portion 422 of each of the plug prongs 42 of the plug member 4 connected to the abutment bevel 424 of the first guide portion 422 abuts against the contact portion 532 of the first guide plate 53 of the corresponding one of the guide terminals 5. At the same time, the second guide portion 423 of each of the plug prongs 42 is still kept abutting against an inner surface of the second guide plate 54 of the corresponding one of the guide terminals 5. The restoring force that is created by bending the first inclined portion 531 of the first guide plate 53 ensures the contact portion 532 tightly abuts against the contact periphery 425 of the first guide portion 422. Further referring to FIG. 11, since each of the first stopper portions 225 of the lower housing member 22 blocks the front edge of the second inclined portion 533 of the first guide plate 53 of the corresponding one of the guide terminals 5, the contact portion 532 is prevented from moving out of contact with the corresponding contact periphery 425 (as shown in FIG. 18) due to bent and deformation in the first inclined portion 531, thereby ensuring that the contact portion 532 is kept in contact with the contact periphery 425 when the plug member 4 is disposed at the protruding position. Since the first and second guide portions 422, 423 of each of the plug prongs 42 are simultaneously in contact with the corresponding one of the guide terminals 5, it is ensured that the plug prongs 42 and the guide terminals 5 are kept in a conductively connecting state, thereby enhancing the stability and the reliability of the conduction.

Referring to FIGS. 16 and 17, when it is desired to move the plug member 4 from the protruding position to the folding position, the plug portions 421 are pushed downwardly in the direction of the arrow (III). Since the position of the rod body 411 is retained by the fixed arm unit 32 and the base 31 cooperatively, the protrusion 412 pushes upwardly against the engaging surface 334 to result in bending of the flexible arm portion 331 of the flexible arm unit 33 relative to the base 31 away from the upright wall 321 of the fixed arm unit 32, so that the protrusion 412 is removed from the positioning groove 38 and disengaged from the engaging surface 334. As shown in FIG. 14, when the first end 414 of the protrusion 412 is rotated to abut against the abutting surface 335 of the securing projection 332, the restoring force stored in the flexible arm portion 331 drives the securing projection 332 to automatically move back to, as shown in FIG. 5, securing the protrusion 412 and the rod body 411 of the pivot rod 41 for firmly positioning the plug member 4 at the folding position.

In this embodiment of the electrical plug device 20, by virtue of the provision of the positioning member 3, the plug member 4 can be firmly positioned at the protruding position where the plug member 4 is pivoted outwardly from the housing 2, and the movement of the plug member 4 away from the protruding position caused by the undesirable external force can be prevented. Hence, the convenience in use is enhanced. Moreover, by virtue of matching of the flexible arm unit 33 of the positioning member 3 with the protrusion 412 of the pivot rod 41, the plug member 4 is able to be automatically positioned at either the protruding position or the folding position, thereby achieving the objects of the present invention.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

We claim:

1. An electrical plug device comprising:

a housing formed with two receptacles;

a positioning member disposed in said housing and including a base that has two opposite ends, a fixed arm unit that extends upwardly from one of said opposite ends of said base and that is inseparably connected to said housing, and a flexible arm unit that extends upwardly from the other of said opposite ends of said base opposite to said fixed arm unit, said base, said fixed arm unit and said flexible arm unit cooperatively defining an engaging groove, said fixed arm unit and said flexible arm unit cooperatively defining an opening in communication with said engaging groove and opposite to said base, said flexible arm unit including a flexible arm portion that is connected to said base and a securing projection that is connected to said flexible arm portion and that is proximate to said opening, said flexible arm portion having an inner surface that faces said fixed arm unit, said securing projection including an engaging surface that is connected to said inner surface and an abutting surface that is connected to said engaging surface, said abutting surface being configured as an inclined surface that extends towards the fixed arm unit, so that said engaging groove gradually decreases in width along a direction towards said opening; and a plug member including a pivot rod that is pivotally coupled to said positioning member and two spaced-apart plug prongs that are connected to said pivot rod, said plug prongs being respectively and removably received in said receptacles, said pivot rod including a rod body that is pivotally received in said engaging groove and that detachably abuts against said abutting surface of said securing projection, and a protrusion that protrudes from said rod body and that is detachably engaged with said engaging surface of said securing projection, said engaging surface of the securing projection being engaged with said protrusion and said abutting surface of said securing projection abutting against said rod body when said plug member is disposed at a protruding position, where said plug prongs of said plug member protrude out of said receptacles, respectively.

2. The electrical plug device as claimed in claim 1, wherein said abutting surface of said securing projection abuts against said protrusion and said rod body when said plug member is disposed at a folding position, where said plug prongs of said plug member are received in said receptacles, respectively.

3. The electrical plug device as claimed in claim 1, wherein said engaging surface is configured as a curved surface, said inner surface of said flexible arm portion cooperating with said engaging surface of the securing projection to define a positioning groove that communicates with the engaging groove and that is engageable with said protrusion.

4. The electrical plug device as claimed in claim 3, wherein said positioning member is formed with a notch by indenting a junction of said base and said flexible arm portion, said notch communicating with said engaging groove.

5. The electrical plug device as claimed in claim 1, wherein said securing projection further includes a guide bevel connected to said abutting surface and opposite to said engaging surface, said flexible arm unit being urged to bend relative to said base when said protrusion abuts against and pushes said guide bevel.

6. The electrical plug device as claimed in claim 1, wherein said housing includes a bottom wall and a top wall spaced apart from said bottom wall, said bottom and top walls cooperatively retaining said positioning member therebetween.

7. The electrical plug device as claimed in claim 6, wherein said fixed arm unit further includes an upright wall that extends from said base and that is spaced apart from said flexible arm unit, and a protruding wall that laterally protrudes from said upright wall in a direction further from the flexible arm unit, said protruding wall being formed with two opposite retaining grooves that extend along a lengthwise direction of the upright wall, said housing further including two spaced-apart positioning ribs extending along the lengthwise direction of the upright wall and engaging said retaining grooves, respectively.

8. The electrical plug device as claimed in claim 7, wherein said base cooperates with said upright wall to define a curved bearing surface for bearing said rod body.

9. The electrical plug device as claimed in claim 1, further comprising two guide terminals disposed in said housing, each of said plug prongs being integrally formed by a punching process and including a plug portion that protrudes from said pivot rod and that is receivable in the corresponding one of said receptacles, a first guide portion that longitudinally protrudes from said pivot rod in a direction opposite to a protruding direction of said plug portion, and a second guide portion that transversely and outwardly protrudes from said pivot rod, said first and second guide portions of each plug prongs being in contact with a corresponding one of said guide terminals.

10. The electrical plug device as claimed in claim 9, wherein said housing is formed with a receiving space communicating with each of said receptacles and two through holes communicating with said receiving space, each of said guide terminals including a base plate that is disposed in said receiving space, a guide sleeve, a first guide plate, and a second guide plate, said base plate having a front end, a rear end, and a lateral end that interconnects said front and rear ends, said guide sleeve of each of said guide terminals extending rearwardly from said rear end of said base plate and being plugged in a corresponding one of said through holes, said first guide plate extending forwardly from said front end of said base plate and abutting against said first guide portion of the corresponding one of said plug prongs, said second guide plate extending upwardly from said lateral end and abutting against said second guide portion of the corresponding one of said plug prongs.

11. The electrical plug device as claimed in claim 10, wherein said housing further includes a blocking plate blocking said guide sleeves of said guide terminals so that said guide sleeves are positioned in said through holes, respectively.

12. The electrical plug device as claimed in claim 11, wherein said first guide plate of each of said guide terminals has a first inclined portion extending forwardly from said front end of said base plate, and a contact portion extending forwardly and horizontally from said first inclined portion, said first guide portion of each of said plug prongs including an abutment bevel that abuts forcedly against said first inclined portion of said first guide plate of the corresponding one of said guide terminals, and a contact periphery that extends from said abutment bevel and that abuts against said contact portion of said first guide plate.

13. The electrical plug device as claimed in claim 12, wherein said first guide plate further includes a second inclined portion extending forwardly from said contact portion and inclined downwardly, said housing further including two spaced-apart first stopper portions, each of which blocks said second inclined portion of said first guide plate of a corresponding one of said guide terminals.

14. The electrical plug device as claimed in claim 11, wherein each of said guide terminals further includes an inclined plate extending downwardly from said front end of said base plate, said housing further including two spaced-apart second stopper portions each being used to secure said inclined plate of a corresponding one of said guide terminals.

15. An electronic apparatus, comprising:

a main body including a casing, an adapter socket that is disposed on said casing, and a circuit board that is disposed in said casing and that is coupled electrically to said adapter socket; and an electrical plug device assembled electrically coupled to said adapter socket, and including a housing formed with two receptacles, a positioning member disposed in said housing and including a base that has two opposite ends, a fixed arm unit that extends upwardly from one of said opposite ends of said base and that is inseparably connected to said housing, and a flexible arm unit that extends upwardly from the other of said opposite ends of said base opposite to said fixed arm unit, said base, said fixed arm unit and said flexible arm unit cooperatively defining an engaging groove, said fixed arm unit and said flexible arm unit cooperatively defining an opening in communication with said engaging groove and opposite to said base, said flexible arm unit including a flexible arm portion that is connected to said base and a securing projection that is connected to said flexible arm portion and that is proximate to said opening, said flexible arm portion having an inner surface that faces said fixed arm unit, said securing projection including an engaging surface that is connected to said inner surface and an abutting surface that is connected to said engaging surface, said abutting surface being configured as an inclined surface that extends towards the fixed arm unit, so that said engaging groove gradually decreases in width along a direction towards said opening, and a plug member including a pivot rod that is pivotally coupled to said positioning member and two spaced-apart plug prongs that are connected to said pivot rod, said plug prongs being respectively and removably received in said receptacles, said pivot rod including a rod body that is pivotally received in said engaging groove and that detachably abuts against said abutting surface of said securing projection, and a protrusion that protrudes from said rod body and that is detachably engaged with said engaging surface of said securing projection, said engaging surface of the securing projection being engaged with said protrusion and said abutting surface of said securing projection abutting against said rod body when said plug member is disposed at a protruding position, where said plug prongs of said plug member protrude out of said receptacles, respectively.

16. The electronic apparatus as claimed in claim 15, wherein said abutting surface of said securing projection abuts against said protrusion and said rod body when said plug member is disposed at a folding position, where the plug prongs of said plug member are received in said receptacles, respectively.

17. The electronic apparatus as claimed in claim 15, wherein said engaging surface is configured as a curved surface, said inner surface of said flexible arm portion cooperating with said engaging surface of the securing projection to define a positioning groove that communicates with the engaging groove and that is engageable with said protrusion.

18. The electronic apparatus as claimed in claim 17, wherein said positioning member is formed with a notch by indenting a junction of said base and said flexible arm portion, said notch communicating with said engaging groove.

19. The electronic apparatus as claimed in claim 15, wherein said securing projection further includes a guide bevel connected to said abutting surface and opposite to said engaging surface, said retaining arm being urged to bend relative to said base when said protrusion abuts against and pushes said guide bevel.

20. The electronic apparatus as claimed in claim 15, wherein said housing includes a bottom wall and a top wall spaced apart from said bottom wall, said bottom and top walls cooperatively retaining said positioning member therebetween.

21. The electronic apparatus as claimed in claim 20, wherein said fixed arm unit further includes an upright wall that extends from said base and that is spaced apart from said flexible arm unit, and a protruding wall that laterally protrudes from said upright wall in a direction further from the flexible arm unit, said protruding wall being formed with two opposite retaining grooves that extend along a lengthwise direction of the upright wall, said housing further including two spaced-apart positioning ribs extending along the lengthwise direction of the upright wall and engaging said retaining grooves, respectively.

22. The electronic apparatus as claimed in claim 21, wherein said base cooperates with said upright wall to define a curved bearing surface for bearing said rod body.

23. The electronic apparatus as claimed in claim 15, wherein said electrical plug device further includes two guide terminals disposed in said housing, each of said plug prongs being integrally formed by a punching process and including a plug portion that protrudes from said pivot rod and that is receivable in the corresponding one of said receptacles, a first guide portion that longitudinally protrudes from said pivot rod in a direction opposite to a protruding direction of said plug portion, and a second guide portion that transversely and outwardly protrudes from said pivot rod, said first and second guide portions of each plug prongs being in contact with a corresponding one of said guide terminals.

24. The electronic apparatus as claimed in claim 15, wherein said housing is formed with a receiving space communicating with each of said receptacles and two through holes communicating with said receiving space, each of said guide terminals including a base plate that is disposed in said receiving space, a guide sleeve, a first guide plate, and a second guide plate, said base plate having a front end, a rear end, and a lateral end that interconnects said front and rear ends, said guide sleeve of each of said guide terminals extending rearwardly from said rear end of said base plate and being plugged in a corresponding one of said through holes, said first guide plate extending forwardly from said front end of said base plate and abutting against said first guide portion of the corresponding one of said plug prongs, said second guide plate extending upwardly from said lateral end and abutting against said second guide portion of the corresponding one of said plug prongs.

25. The electronic apparatus as claimed in claim 24, wherein said housing further includes a blocking plate blocking said guide sleeves of said guide terminals so that said guide sleeves are positioned in said through holes, respectively.

26. The electronic apparatus as claimed in claim 25, wherein said first guide plate of each of said guide terminals has a first inclined portion forwardly extending from said front end of said base plate, and a contact portion extending forwardly and horizontally from said first inclined portion, said first guide portion of each of said plug prongs including an abutment bevel that abuts forcedly against said first inclined portion of said first guide plate of the corresponding one of said guide terminals, and a contact periphery that extends from said abutment bevel and that abuts against said contact portion of said first guide plate.

27. The electronic apparatus as claimed in claim 26, wherein said first guide plate further includes a second inclined portion extending forwardly from said contact portion and inclined downwardly, said housing further including two spaced-apart first stopper portions, each of which blocks said second inclined portion of said first guide plate of a corresponding one of said guide terminals.

28. The electronic apparatus as claimed in claim 25, wherein each of said guide terminals further includes an inclined plate extending downwardly from said front end of said base plate, said housing further including two spaced-apart second stopper portions each being used to secure said inclined plate of a corresponding one of said guide terminals.

* * * * *